US009920999B2

(12) United States Patent
Bellenfant et al.

(10) Patent No.: US 9,920,999 B2
(45) Date of Patent: Mar. 20, 2018

(54) HEAT EXCHANGER AND INTEGRATED AIR-CONDITIONING ASSEMBLY INCLUDING SUCH EXCHANGER

(75) Inventors: Aurélie Bellenfant, Roézé sur Sarthe (FR); Jimmy Lemee, Saint Jean d'Asse (FR); Lionel Renault, Oizé (FR); Frédéric Bernard, Ferce sur Sarthe (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 1502 days.

(21) Appl. No.: 12/933,152

(22) PCT Filed: Mar. 17, 2009

(86) PCT No.: PCT/EP2009/001932
§ 371 (c)(1),
(2), (4) Date: Dec. 20, 2010

(87) PCT Pub. No.: WO2009/115284
PCT Pub. Date: Sep. 24, 2009

(65) Prior Publication Data

US 2011/0083468 A1 Apr. 14, 2011

(30) Foreign Application Priority Data

Mar. 20, 2008 (FR) ..... 08 01546

(51) Int. Cl.
*F28D 9/04* (2006.01)
*F28D 7/00* (2006.01)
(Continued)

(52) U.S. Cl.
CPC ..... *F28D 7/0033* (2013.01); *F25B 40/00* (2013.01); *F28D 7/04* (2013.01); *F25B 2309/061* (2013.01); *F25B 2500/18* (2013.01)

(58) Field of Classification Search
CPC .... F28D 7/04; F28D 2021/007; F28D 7/0033; F25B 2500/18; F25B 23/00;
(Continued)

(56) References Cited

U.S. PATENT DOCUMENTS 2,136,086 A * 11/1938 Rosenblad ..... F28D 9/04 138/148
2,136,153 A * 11/1938 Rosenblad ..... B21D 53/027 165/165
(Continued)

FOREIGN PATENT DOCUMENTS

DE 3634871 A1 5/1987
EP 0061779 A2 10/1982
(Continued)

OTHER PUBLICATIONS

English language abstract for DE 3634871 extracted from espacenet.com database, dated Nov. 2, 2010, 7 pages.
(Continued)

*Primary Examiner* — Frantz Jules
*Assistant Examiner* — Martha Tadesse
(74) *Attorney, Agent, or Firm* — Howard & Howard Attorneys PLLC

(57) ABSTRACT

The invention relates to a heat-exchanger for an air-conditioning circuit that includes a first pipe (110) defining a path for a flow of fluid, the first pipe being spirally wound about a so-called exchanger axis (A). According to the invention, the heat exchanger (9) further includes at least one second pipe (120*a*, 120*b*) defining a path for a flow of a second fluid, said second pipe being provided against a surface of the first pipe (110) and spirally wound together with said first pipe (110) about said axis (A). The invention can be used in air-conditioning circuits operating with a super-critical coolant, in particular carbon dioxide (CO2).

14 Claims, 3 Drawing Sheets

(51) Int. Cl.
*F25B 40/00* (2006.01)
*F28D 7/04* (2006.01)

(58) Field of Classification Search
CPC .. F25B 43/006; F25B 40/00; F25B 2309/061; F28F 2013/006
USPC ..... 62/515, 503; 165/172, 140
See application file for complete search history.

(56) References Cited

U.S. PATENT DOCUMENTS

| | | | | |
|---|---|---|---|---|
| 4,100,762 | A * | 7/1978 | Davis | F25B 13/00 62/160 |
| 4,655,174 | A * | 4/1987 | Fillios | F24H 1/24 122/134 |
| 4,785,878 | A | 11/1988 | Honkajarvi et al. | |
| 5,242,015 | A * | 9/1993 | Saperstein | F28H 1/022 165/163 |
| 6,681,597 | B1 * | 1/2004 | Yin | F25B 40/00 62/503 |
| 6,935,414 | B2 * | 8/2005 | Kawakubo | F25B 40/00 165/110 |
| 2002/0083733 | A1 * | 7/2002 | Zhang | F25B 40/00 62/503 |
| 2002/0092646 | A1 * | 7/2002 | Kuhn | F28D 7/04 165/163 |
| 2002/0148600 | A1 * | 10/2002 | Bosch | F01M 5/00 165/163 |
| 2003/0056532 | A1 * | 3/2003 | Dickson | F25B 43/006 62/471 |
| 2003/0121648 | A1 * | 7/2003 | Hong | F25B 40/00 165/163 |
| 2006/0196223 | A1 * | 9/2006 | Dexter | F25B 43/006 62/503 |
| 2007/0264538 | A1 * | 11/2007 | Schank | F24F 6/043 429/414 |
| 2008/0041093 | A1 * | 2/2008 | Sung | F25B 43/006 62/503 |
| 2009/0114380 | A1 * | 5/2009 | Grabon | F28D 7/0033 165/181 |
| 2010/0155012 | A1 * | 6/2010 | Lemee | F25B 40/00 165/10 |

FOREIGN PATENT DOCUMENTS

| | | | | | |
|---|---|---|---|---|---|
| EP | 0529819 | A2 | | 3/1993 | |
| FR | 2752921 | A1 | | 3/1998 | |
| FR | 2913764 | A1 | | 9/2008 | |
| GB | 2316738 | A | | 3/1998 | |
| JP | 09-113152 | A | | 5/1997 | |
| JP | 2000346584 | A | * | 12/2000 | F28D 7/0033 |
| JP | 2002107069 | A | * | 4/2002 | F28D 7/0033 |
| JP | 2007-178115 | A | | 7/2007 | |
| JP | 51-88866 | | * | 4/2013 | |
| WO | WO 01-57454 | A1 | | 8/2001 | |
| WO | WO 2007-136379 | A1 | | 11/2007 | |

OTHER PUBLICATIONS

English language abstract for EP 0061779 extracted from espacenet.com database, dated Nov. 2, 2010, 11 pages.
English language abstract for FR 2752921 extracted from espacenet.com database, dated Nov. 5, 2010, 20 pages.
English language abstract for FR2913764 extracted from espacenet.com database, dated Nov. 2, 2010, 38 pages.
English language translation and abstract for JP 09-113152 extracted from PAJ database, dated Nov. 5, 2010, 25 pages.
English language translation and abstract for JP 2007-178115 extracted from PAJ database, dated Nov. 5, 2010, 38 pages.
PCT International Search Report for PCT/EP2009/001932, dated Aug. 4, 2009, 4 pages.

* cited by examiner

HEAT EXCHANGER AND INTEGRATED AIR-CONDITIONING ASSEMBLY INCLUDING SUCH EXCHANGER

RELATED APPLICATIONS

This application claims priority to and all the advantages of International Patent Application No. PCT/EP2009/001932, filed on Mar. 17, 2009, which claims priority to French Patent Application No. FR 08/01546, filed on Mar. 20, 2008.

This invention relates to a heat exchanger for an air conditioning system. It also relates to a use of said heat exchanger as an internal exchanger of an air conditioning system, an integrated assembly for an air conditioning system operating with a coolant, and an air conditioning system comprising such an integrated assembly.

The invention is has a particularly advantageous use in the field of air conditioning systems operating with a supercritical coolant, such as carbon dioxide (CO2).

Air conditioning systems of this type generally include a compressor, a gas cooler, an internal exchanger, an expansion chamber and an accumulator. The coolant brought to high-pressure by the compressor is sent to the gas cooler in order to be cooled. The high-pressure fluid from the cooler then circulates in a first branch of the internal exchanger, and then is expanded by the expansion chamber. The low-pressure fluid then passes through the evaporator, then the accumulator before circulating in a second branch of the internal exchanger. The coolant then turns to the compressor to undergo another cycle.

In the internal exchanger, the hot high-pressure fluid circulating in the first branch exchanges heat with the cold low-pressure fluid circulating in the second branch.

The accumulator arranged at the outlet of the evaporator is designed to store the excess liquid present in the cold low-pressure fluid leaving the evaporator. This accumulator is generally in the form of a tank suitable for separating the liquid portion of the coolant from the gaseous portion. The accumulator sends the gaseous portion of the low-temperature coolant to the compressor after having passed through the internal exchanger.

Among the numerous internal exchangers known are that which, associated with a horizontal accumulator, forms the integrated assembly described in the French patent application no. 2 752 921. In this integrated assembly, the internal exchanger has a general spiral shape. A separation is provided between the windings of the internal exchanger so as to enable the circulation of the cold fluid, while the hot fluid circulates inside the tube wound in a spiral in parallel channels arranged perpendicularly to the axis of the tube.

This solution however involves providing a space between each winding in order to create the channel for the low-pressure fluid. It consequently creates significant diametral bulk.

To overcome this disadvantage, a heat exchanger for an air conditioning system, including a tube defining a path for the circulation of a fluid, called high-pressure fluid, and a second fluid, called low-pressure fluid, in which the tube is wound around an axis so as to define successive windings, has been proposed.

Also, in this exchanger, the successive windings of the tube are closely fit together so as to define leak-proof channels, called secondary channels, for the circulation of the second fluid, in which these secondary channels are located between projecting areas of the tube. The tube also has channels, called main channels, arranged in the projecting areas, intended to be passed through by the first fluid.

This known heat exchanger comprises an internal core with a substantially cylindrical shape placed at the center of the tube and consisting of a plurality of nested elements that simultaneously ensure the winding of the tube, the discharge of the first fluid at the outlet of the main channels and the supply of a second fluid at the inlet of the secondary channels.

However, this solution requires the implementation of a relatively complex internal core.

Another objective of the invention is to propose a heat exchanger for an air conditioning system that would in particular enable the architecture of the aforementioned known exchanger to be simplified at the outlet for the first fluid and the inlet for the second fluid.

This objective is achieved, according to the invention, by a heat exchanger for an air conditioning system, including a first tube defining a path for the circulation of a first fluid, called a high-pressure fluid, in which said first tube is wound in a spiral about an axis, called the axis of the exchanger, notable in that said heat exchanger also includes at least one second tube defining a path for the circulation of a second fluid, called a low-pressure fluid, in which said second tube is fastened to a face of the first tube and wound in a spiral with said first tube about said axis.

Thus, as will be seen in detail below, because the first and second fluids circulate in separate tubes, it is possible to separate the outlet of the first tube and the inlet of the second tube and therefore to provide separate means for discharging the first fluid and for supplying the second fluid, instead of requiring a single complex part simultaneously performing these two functions.

The invention also relates to a use of the heat exchanger according to the invention as an internal exchanger of an air conditioning system, notable in that said first fluid is a high-pressure fluid and said second fluid is a low-pressure fluid. In particular, said first and second fluids are made up of the same coolant, in particular a supercritical fluid.

According to an embodiment of the invention, said first tube comprises a plurality of main parallel channels each defining a path for circulation of the first fluid in a spiral about the axis of the exchanger. Advantageously, said main channels have a substantially circular cross-section for better resistance to the pressure of the first tube in which the first high-pressure fluid circulates.

Similarly, according to the invention, said second tube comprises a plurality of secondary parallel channels each defining a path for circulation of the second fluid in a spiral about the axis of the exchanger. Advantageously, said secondary channels have a substantially rectangular cross-section for a better surface for heat exchange between the second low-pressure fluid circulating in the second tube and the first high-pressure fluid circulating in the first tube.

In a preferred embodiment of the invention, the heat exchanger includes two second tubes fastened respectively to a face of the first tube.

This embodiment indeed makes it possible to obtain, by increasing the passage sections provided for the second tube, a reduction in head losses in the second branch of the exchanger, where the second low-pressure fluid circulates.

Of course, the invention nevertheless remains open to any number of second tubes for circulation of the second low-pressure fluid.

The invention also relates to an integrated assembly for an air conditioning system operating with a coolant, notable in that said integrated assembly comprises a housing in which an internal exchanger according to the invention is housed, between a lid and a base, in which said base is equipped with an inlet allowing the second fluid into the windings formed by said first and second tubes, and in that said housing comprises a second outlet tubing for the second fluid, parallel to the axis of the exchanger and comprising an outlet opening.

According to a particular embodiment, the integrated assembly according to the invention comprises a secondary inlet tubing for said second fluid, parallel to the axis of the exchanger and of which one end communicates with said outlet through said base.

According to this particular embodiment of the invention, said integrated assembly comprises an accumulator connected to the base of said integrated assembly, into which said second inlet tubing leads so as to communicate with said outlet.

According to a first alternative, the main tubings and the secondary tubings are arranged for co-current circulation of the first fluid in the first tube with that of the second fluid in the second tube.

According to a second alternative, the main tubings and the secondary tubings are arranged for counter-current circulation of the first fluid in the first tube with that of the second fluid in the second tube.

The invention finally relates to an air conditioning system operating with a coolant, including a compressor, a gas cooler, an expansion chamber and an evaporator, notable in that said air conditioning system comprises an integrated element according to the invention, in which the main inlet tubing is connected to the gas cooler and the main outlet tubing is connected to the expansion chamber, while the secondary inlet tubing is connected to the evaporator and the secondary outlet tubing is connected to the compressor.

The following description relating to the appended drawings, provided as non-limiting examples, will facilitate understanding of the invention and how it can be produced.

FIG. 1 shows an air conditioning system 10 operating with a coolant, in particular a supercritical coolant, for example carbon dioxide (CO2).

Figure 1:
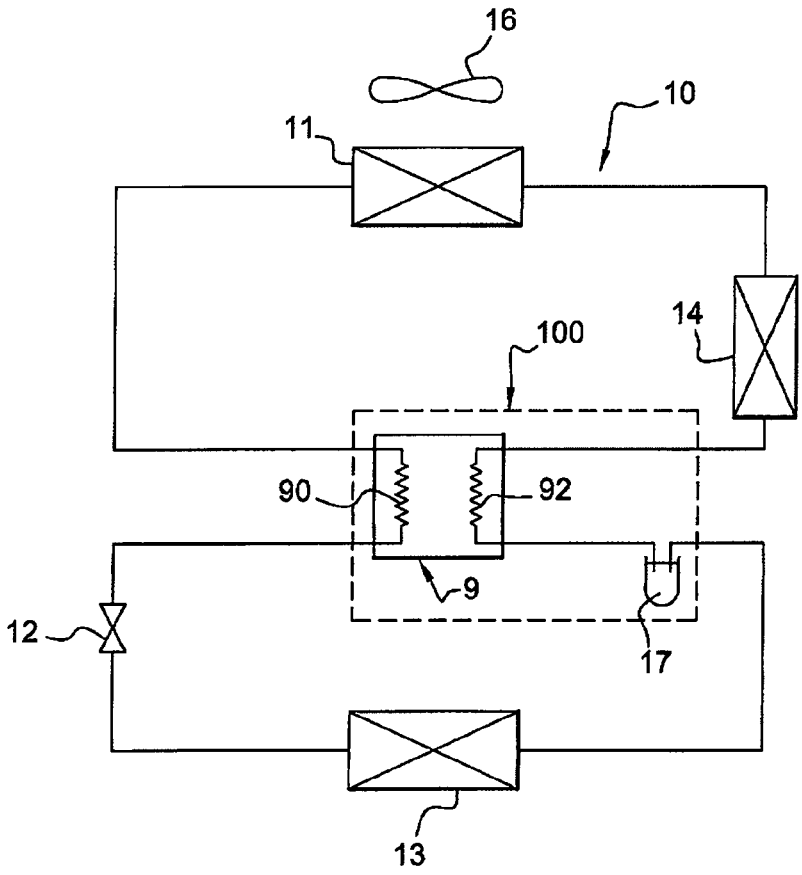
FIG. 1 is a diagram of an air conditioning system according to the invention.

The air conditioning system 10 can be installed in a motor vehicle in order to cool the air of the vehicle interior, as needed by the passengers.

Such an air conditioning system operating according to a supercritical coolant cycle essentially includes a compressor 14, a gas cooler 11 associated with a fan 16, an internal heat exchanger 9, an expansion chamber 12, an evaporator 13 and an accumulator 17.

The compressor 14 compresses the coolant to a discharge pressure, called high pressure. The fluid then passes through the gas cooler 11 where it is subjected to cooling in the gaseous phase under high-pressure. During this cooling, the fluid is not condensed, unlike the air conditioning systems that use fluorinated compounds such as coolant.

The fluid thus cooled by the gas cooler 11 then circulates in a first branch 90 of the internal heat exchanger 9, called the "hot" branch, so as to be cooled again. The fluid then goes into the expansion chamber 12, which reduces its pressure, bringing it at least partially into the liquid state.

The fluid passing through the evaporator 13 then changes into the gaseous state under constant pressure. The heat exchange in the evaporator 13 enables an air conditioned air flow to be produced, which is sent to the vehicle interior.

Generally, the coolant leaving the evaporator is not entirely vaporized. The accumulator 17 is provided at the outlet of the evaporator 13 in order to store the excess liquid still contained in the fluid. The classic accumulators are in the form of a tank suitable for separating the liquid portion of the coolant from the gaseous portion.

The accumulator 17 then sends the gaseous portion of the low-temperature coolant into a second branch 92 of the internal heat exchanger, called the "cold" branch, for a heat exchange with the high-temperature coolant circulating in the "hot" branch 90.

As shown in FIG. 1, the accumulator 17 and the internal heat exchanger 9 can be joined in a single component 100. This is referred to as an "integrated assembly".

Figure 2:
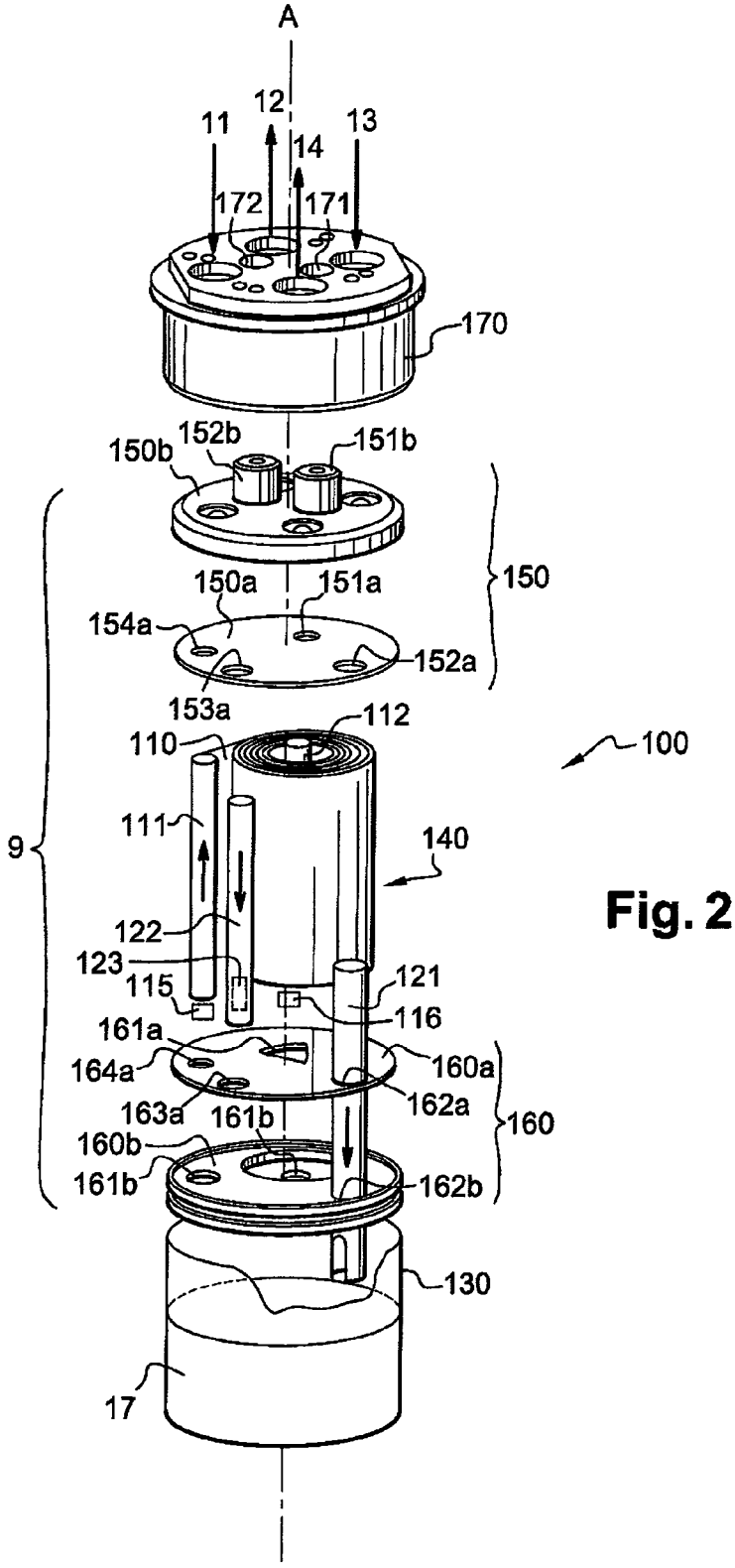
FIG. 2 is an exploded perspective view of an integrated assembly for the air conditioning system of FIG. 1.

FIG. 2 shows such an integrated assembly 100 including, in the same housing 130, an accumulator 17 on which an internal heat exchanger 9 is mounted.

The internal exchanger 9 of FIG. 2 is essentially organized around a device 140 for heat exchange between the high-pressure fluid and the low-pressure fluid. According to FIG. 3, this device 140 includes a first tube 110, which defines a path for the circulation of the high-pressure fluid, which first tube 110 is wound in a spiral about an axis A, which will hereinafter be referred to as the axis of the exchanger. The heat exchange device 140 also includes two second tubes 120*a*, 120*b*, each defining a path for circulation of the second low-pressure fluid. These second tubes are fastened to a respective face of the first tube 110 and wound in a spiral simultaneously with said first tube about the axis A of the internal exchanger 9. At each winding, the internal wall of the second internal tube 120*a* can come into contact with the external wall of the second external tube 120*b*. The coolant is identical in the first tube 110 and in the second tube 120*a*, 120*b*, with the exception of the pressure level. Indeed, this fluid is subjected to a pressure (called high pressure) in the first tube 110, greater than the pressure (called low pressure) of the fluid in the second tube 120*a*, 120*b*.

In other words, the first high-pressure tube is sandwiched between the second low-pressure tubes 120*a*, 120*b* so as to promote an exchange between the high-pressure fluid and the low-pressure fluid.

Figure 4:
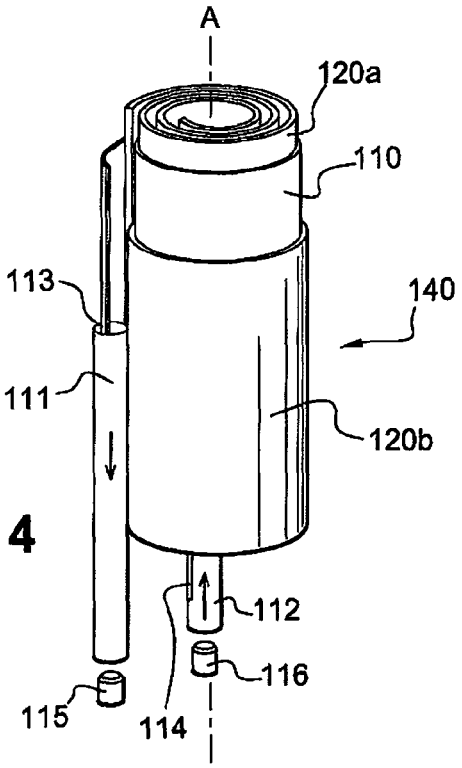
FIG. 4 is a diagrammatic perspective view of the heat exchange device of the integrated assembly of FIGS. 2 and 3.

The way in which the different tubes are arranged with respect to one another in the heat exchange device 140 is also shown in FIG. 4. In practice, the tubes 110, 120*a*, 120*b* can be extruded and fastened to one another by brazing or bonding.

The circulation of the high-pressure fluid in the first tube 110 is ensured by a plurality of main parallel channels each defining a path for circulation of the high-pressure fluid in a spiral about the axis A of the exchanger. These main channels are contained in successive planes perpendicular to axis A. Although they are not shown in the figures, the French patent no. 2 752 921 provides a description of such main channels.

Advantageously, said main channels have a substantially circular cross-section so as to provide better resistance to pressure.

This same structure of channels can also be implemented in each second tube 120*a*, 120*b* of the secondary channels each defining a path for circulation of the low-pressure fluid in a spiral about the axis A of the exchanger, in which these main channels are contained in successive planes perpendicular to axis A.

Advantageously, said secondary channels have a substantially rectangular cross-section so as to provide a larger surface for heat exchange with the first tube 110 and to reduce the head losses along the path followed by the low-pressure fluid while providing the maximum effective passage section for the fluid through the second tubes 120*a*, 120*b*.

Figure 3:
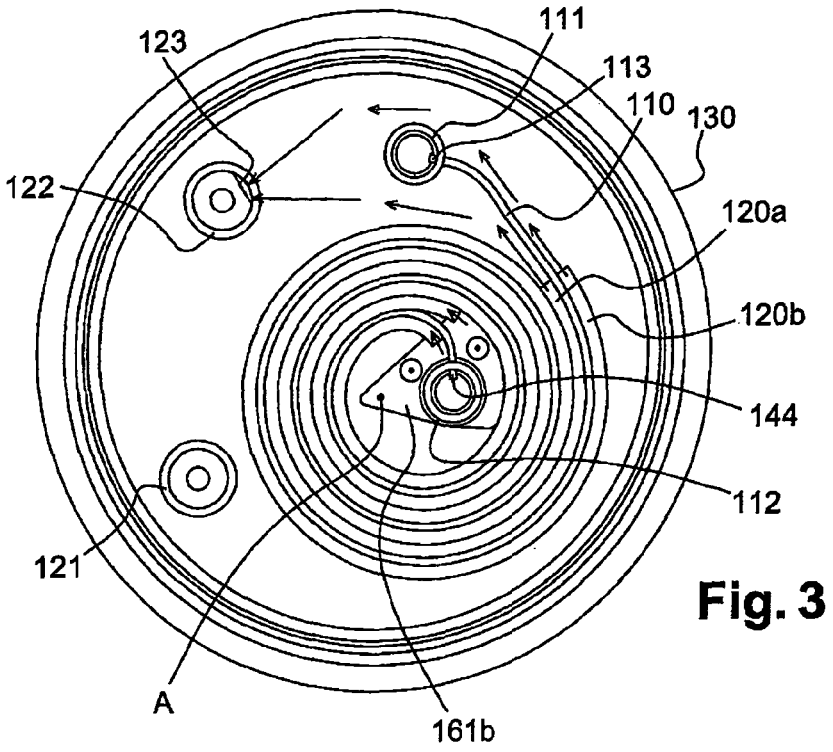
FIG. 3 is a top view of the integrated assembly of FIG. 2.

As shown more specifically in FIGS. 3 and 4, the ends of the main channels of the first tube 110 extend between a main inlet tubing 111 capable of receiving the high-pressure fluid coming from the gas cooler 11 of the air conditioning system, and a main outlet tubing 112 capable of delivering the high-pressure fluid to the outside of the exchanger, in particular to the expansion chamber 12 of the air conditioning system. These main tubings 111, 112 have a substantially cylindrical shape with an axis parallel to the axis A of the exchanger and respectively having an opening 113, 114, shown in FIGS. 3 and 4, capable of receiving one of the ends of the first tube 110.

The main tubings 111, 112 are not in contact with the internal or external faces of the second tubes 120*a*, 120*b*.

In practice, the main tubings 111, 112 are brazed or bonded to the ends of the first tube 110. Similarly, it can be seen in FIGS. 2 and 4 that the main tubings 111, 112 are closed at one of their ends by caps 115, 116, which are produced by a closure member attached to or directly integrated with the tubing 111 or 112, for example by a folding and a brazing of the end.

As can be seen in FIGS. 2 and 3, the heat exchange device 140 equipped with main tubings 111, 112 is housed inside the housing 130 between a lid 150 and a base 160. This space also houses secondary tubings 121, 122 intended to control the circulation of the low-pressure fluid in the internal exchanger 9.

More specifically, a secondary inlet tubing 121 for the low-pressure fluid is provided, parallel to axis A of the exchanger, intended to receive the low-pressure fluid coming from the evaporator 13 of the air conditioning system, and to send it into the accumulator 17, passing through the base 160 of the exchanger. The low-pressure fluid separated from its liquid phase leaves the accumulator 17 through an inlet 161*a*, 161*b* for the low-pressure fluid in the heat exchange device 140, inside the windings formed by the first tube 110 and the second tubes 120*a*, 120*b*.

After having circulated in the two second tubes 120*a*, 120*b* and having exchanged heat with the high-pressure fluid circulating in the first tube 110, the low-pressure fluid arrives at the secondary channels in the housing 130 where it is collected by a secondary outlet tubing 122 equipped with an opening 123. The low-pressure fluid is then sent through the secondary outlet tubing 122 outside the exchanger in the direction of the compressor 14 of the air conditioning system.

In the embodiment of FIG. 2, the base 160 includes two plates 160*a*, 160*b*.

The plate 160*a*, called the upper base plate, comprises holes 163*a*, 164*a* on which the secondary outlet tubing 122 for the low-pressure fluid and the main inlet tubing 111 for the high-pressure fluid are respectively brazed. Another hole referenced 162*a* is formed in the upper base plate 160*a* through which the secondary inlet tubing 121 for the low-pressure fluid passes. At the level of this hole, two alternatives are possible: one in which the secondary tubing 121 is brazed on the plate 160*a* at the level of the hole, and another in which the secondary tubing 121 is not mechanically connected to the plate 160*a*. Another hole 161*a* located substantially at the center of the windings of the tubes is instrumental to the inlet 160 for the low-pressure fluid in the heat exchange device 140.

The plate 160*b*, called the lower base plate, comprises a hole 162*b* for the passage of the secondary inlet tubing 121 for the low-pressure fluid, a hole 164*b* for the housing of the cap 115 of the main inlet tubing 111 for the high-pressure fluid and a hole 161*b* forming, with the hole 161*a* of the upper base plate 160*a*, the opening 160 for the low-pressure fluid. The secondary outlet tubing 122 for the low-pressure fluid simply comes into contact with the lower base plate 160*b*.

Similarly, the lid 150 of the exchanger consists of two plates referenced 150*a*, 150*b*.

The plate 150*a*, called the lower lid plate, comprises four holes 151*a*, 152*a*, 153*a*, 154*a* on which the main outlet tubing 112 for the high-pressure fluid, the secondary inlet tubing 121 for the low-pressure fluid, the secondary outlet tubing 122 of the high-pressure fluid and the main inlet tubing 111 for the high-pressure fluid are brazed.

The plate 150*b*, called the upper lid plate, enables the inlets/outlets for the high- and low-pressure fluids of the internal exchanger 9 to be connected to the corresponding inlets/outlets on the user side, which are located on a cap 170 capable of being attached on pins 151*b*, 152*b* of the upper lid plate 150*b* by means of screws passing through holes 171, 172 of the cap 170. Alternatively, the connection between the cap 170 and the upper plate 150*b* is produced by brazing at the level of the pints 151*b* and 152*b*.

It can be seen in the embodiment of FIG. 3 that the high-pressure fluid and the low-pressure fluid circulate in their respective tubes at counter-current. It is, however, possible to envisage a co-current circulation. For this, it is simply necessary to reverse the roles of the main tubings 111, 112 and to cause the high-pressure fluid to enter the first tube 110 by the main tubing 112 and to be collected at the outlet of the first tube 110 by the main tubing 111.

The accumulator is a separate part mechanically connected to the base 160 of the integrated assembly.

Alternatively, it is the accumulator that defines the housing 130 of the integrated assembly, which housing has the shape of a vat in which the bottom portion defines a chamber for receiving the fluid subjected to low pressure, which bottom portion extends plumb over the internal exchanger so as to end with an area of overlap with the cap 170, in which the latter enters the accumulator. It is therefore understood that the integrated assembly according to the invention is arranged and connected above the accumulator or is completely integrated in the accumulator.

The above description identifies a first fluid and a second fluid, but it is clear that, in a preferred embodiment of the invention, this fluid is identical and circulates in a closed loop in what forms the air conditioning system according to the invention.

The invention claimed is:

1. An integrated assembly (100) for an air conditioning system (10) operating with a coolant including a heat exchanger (9), the heat exchanger (9) including a first tube (110) defining a path for the circulation of a fluid, in which the first tube (110) is wound in a spiral about an axis (A), called the axis of the heat exchanger (9), wherein the heat exchanger (9) also includes two second tubes (120*a*, 120*b*) defining a path for the circulation of the fluid, in which the two second tubes (120*a*, 120*b*) are fastened respectively to a face of the first tube (110) and wound in a spiral with the first tube (110) about the axis (A), wherein the two second tubes (120*a*, 120*b*) are a second internal tube (120*a*) and a second external tube (120*b*), and wherein at each winding, an internal wall of the second internal tube (120*a*) is in contact with an external wall of the second external tube (120*b*), and including a main inlet tubing (111) is capable of receiving the fluid, a main outlet tubing (112) is capable of delivering the fluid to the outside of the heat exchanger, a secondary inlet tubing (121) is spaced radially from the first tube and the second tubes and the main inlet tubing and the main outlet tubing and extending axially from a first end to a second end for the fluid, parallel to the axis (A) of the heat exchanger (9) and a secondary outlet tubing (122) is spaced radially from the first tube and the second tubes and the main inlet tubing and the main outlet tubing and extending axially from a first end to a second end for the fluid, parallel to the axis (A) of the heat exchanger (9) to control circulation of the low-pressure fluid in the heat exchanger (9), in which the first end and second end of the first tube extends between the main inlet tubing and the main outlet tubing;

a housing (130) having a lid (150) and a base (160) between which the heat exchanger (9) is housed, the lid (150) comprising a lower lid plate (150*b*) having a plurality of holes (151*a*, 152*a*, 153*a*, 154*a*) on which the main outlet tubing (112), the secondary inlet tubing (121), the secondary outlet tubing (122), and the main inlet tubing (111) are brazed, and an upper lid plate (150*b*) having a plurality of holes aligned with the holes (151*a*, 152*a*, 153*a*, 154*a*) of the lower lid plate (150*b*) and a plurality of pins (151*b*, 152*b*) extending axially therefrom;

a cap (170) having a plurality of first holes being capable of being attached on the pins (151*b*, 152*b*) of the upper lid plate (150*b*) and having a plurality of second holes aligned with the holes in the upper lid plate (150*b*) to allow inlets/outlets of the high and low-pressure fluids of the heat exchanger (9) to be connected to corresponding external inlets/outlets of the air conditioning system (10); and a plurality of fasteners extending through the first holes of the cap (170) to attach the cap (170) to the pins (151*b*, 152*b*).

2. The integrated assembly (100) according to claim 1, in which at least one of the main inlet and outlet tubing (111, 112) has a substantially cylindrical shape with an axis parallel to the axis (A) of the heat exchanger (9), and has an opening (113, 114) capable of receiving an end of the first tube (110).

3. The integrated assembly (100) according to claim 1, in which said first (110) and second (120*a*, 120*b*) tubes are extruded.

4. The integrated assembly (100) according to claim 1, in which the first (110) and second (120*a*, 120*b*) tubes are fastened by brazing or bonding.

5. A method of operating the heat exchanger according to claim 1 as an internal heat exchanger (9) of an air conditioning system (10), characterized by passing the fluid through the first tube (110) as a high-pressure fluid, and passing the fluid through the second tube (120*a*, 120*b*) as a low-pressure fluid.

6. The method of operating according to claim 5, in which the high-pressure fluid and the low-pressure fluid comprise the same coolant.

7. The method of operating according to claim 6, in which the coolant is a supercritical fluid.

8. The integrated assembly (100) according to claim 1, in which the base (160) is equipped with an inlet (161*a*, 161*b*) allowing the second fluid into the windings formed by the first (110) and second (120*a*, 120*b*) tubes, and in that the housing (130) includes the secondary outlet tubing (122) and comprising an outlet opening (123).

9. The integrated assembly (100) according to claim 8, comprising the secondary inlet tubing (121) of which one end communicates with the outlet (161*a*, 161*b*) through the base (160).

10. The integrated assembly (100) according to claim 9, comprising an accumulator (17) connected to the base (160), into which the secondary inlet tubing (121) leads so as to communicate with the outlet (161*a*, 161*b*).

11. The integrated assembly (100) according to claim 8, in which the housing (130) extends in the extension of the heat exchanger (9) after the base (160) and comprises a chamber for receiving the low-pressure fluid.

12. The integrated assembly (100) according to claim 8, in which the main tubings (111, 112) and the secondary tubings (121, 122) are arranged for co-current circulation of the fluid in the first tube (110) with that of the fluid in the second tube (120*a*, 120*b*).

13. The integrated assembly (100) according to claim 8, in which the main tubings (111, 112) and the secondary tubings (121, 122) are arranged for counter-current circulation of the fluid in the first tube (110) with that of the fluid in the second tube (120*a*, 120*b*).

14. An air conditioning system (10) operating with a coolant, including a compressor (14), a gas cooler (11), an expansion chamber (12), and an evaporator (13), characterized in that the air conditioning system (10) comprises the integrated assembly (100) according to claim 8, in which the main inlet tubing (111) is connected to the gas cooler (11) and the main outlet tubing (112) is connected to the expansion chamber (12), while the secondary inlet tubing (121) is connected to the evaporator (13), and the secondary outlet tubing (122) is connected to the compressor (14).

* * * * *